US010717201B2

(12) United States Patent
Fuerst et al.

(10) Patent No.: US 10,717,201 B2
(45) Date of Patent: Jul. 21, 2020

(54) SHAVER WITH LIGHT SOURCE

(71) Applicant: Braun GmbH, Kronberg (DE)

(72) Inventors: Stefan Fuerst, Kronberg (DE); Martin Fuellgrabe, Bad Camberg (DE); Christian Neyer, Eschborn (DE); Christian Schuebel, Frankfurt am Main (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 15/879,514

(22) Filed: Jan. 25, 2018

(65) Prior Publication Data

US 2018/0207822 A1 Jul. 26, 2018

(30) Foreign Application Priority Data

Jan. 26, 2017 (EP) ..... 17153254

(51) Int. Cl.

| | |
|---|---|
| ***B26B 19/46*** | (2006.01) |
| ***A45D 27/00*** | (2006.01) |
| ***B26B 19/38*** | (2006.01) |
| *A45D 26/00* | (2006.01) |

(52) U.S. Cl.

CPC ..... *B26B 19/46* (2013.01); *A45D 27/00* (2013.01); *B26B 19/3873* (2013.01); *A45D 26/0033* (2013.01); *A45D 2026/008* (2013.01)

(58) Field of Classification Search

CPC ..... A45D 27/00; B26B 19/3873; B26B 19/46
USPC ..... 30/34.05, 34.1, 43.4–46, 194–221
See application file for complete search history.

(56) References Cited

U.S. PATENT DOCUMENTS

| | | | | |
|---|---|---|---|---|
| 2,965,748 A | 12/1960 | Bonanno | | |
| 5,743,214 A * | 4/1998 | McClain | A01K 14/00 | 119/601 |
| 6,406,157 B1 * | 6/2002 | Audet | A45D 24/36 | 30/34.05 |
| 6,481,104 B1 * | 11/2002 | Parker | B26B 21/38 | 30/45 |
| 6,533,775 B1 * | 3/2003 | Rizoiu | A61B 18/203 | 30/34.1 |
| 6,612,034 B2 * | 9/2003 | Damstra | B25F 5/00 | 30/43.6 |
| 6,871,402 B2 * | 3/2005 | Bader | B26B 19/46 | 30/43.92 |

(Continued)

FOREIGN PATENT DOCUMENTS

| | | | |
|---|---|---|---|
| DE | 965 682 C | 6/1957 | |
| DE | 2645912 A1 * | 4/1978 | B26B 19/46 |

(Continued)

OTHER PUBLICATIONS

European search report dated Jul. 19, 2017.

*Primary Examiner* — Jason Daniel Prone
(74) *Attorney, Agent, or Firm* — Kevin C. Johnson; Gerd Zetterer

(57) ABSTRACT

The present invention is concerned with an electrically operable hair removing device, such as a shaver comprising a housing, an energy source located in the housing, at least one hair removal unit and at least one electrically operated equipment, like a light source, which is movable relative to the housing. During its use, the at least one electrically operated equipment is not directly connected to the energy source located in the housing.

13 Claims, 2 Drawing Sheets

(56) References Cited

U.S. PATENT DOCUMENTS 7,114,257 B1 * 10/2006 Ortega ..... A61C 17/32 30/43.92
7,540,087 B2 * 6/2009 Rawle ..... B26B 21/4043 30/34.05
7,739,797 B2 * 6/2010 Rawle ..... B26B 21/4043 30/34.05
9,174,351 B2 * 11/2015 Binder ..... A45D 26/00
9,193,076 B2 * 11/2015 Taijeron ..... B26B 19/3826
9,249,948 B2 * 2/2016 Darwinkel ..... B26B 19/46
9,848,174 B2 * 12/2017 Binder ..... A45D 26/00
9,919,437 B2 * 3/2018 Veltman ..... B26B 19/388
9,950,434 B2 * 4/2018 Binder ..... A45D 26/00
9,950,435 B2 * 4/2018 Binder ..... A45D 26/00
10,335,967 B2 * 7/2019 Neyer ..... B26B 19/102
2004/0024430 A1 * 2/2004 Bader ..... B26B 19/38 607/88
2004/0194316 A1 * 10/2004 Lin ..... B26B 19/38 30/34.05
2005/0150112 A1 * 7/2005 Cafaro ..... B26B 19/38 30/34.05
2007/0107229 A1 * 5/2007 Ribal ..... B26B 19/46 30/34.05
2008/0034591 A1 * 2/2008 Fung ..... B26B 19/02 30/43.92
2008/0250645 A1 * 10/2008 Tringali ..... B26B 19/06 30/34.05
2009/0158596 A1 * 6/2009 Ouchi ..... B26B 19/102 30/45
2009/0223056 A1 * 9/2009 Wilson ..... B26B 19/28 30/34.1
2010/0037463 A1 * 2/2010 Maichel ..... B26B 19/3813 30/34.1
2010/0186234 A1 * 7/2010 Binder ..... A45D 26/00 30/34.05
2011/0067243 A1 * 3/2011 Darwinkel ..... B26B 19/14 30/42
2013/0042481 A1 * 2/2013 Lombardo ..... B26B 19/46 30/34.05
2013/0250084 A1 * 9/2013 Binder ..... A45D 26/00 348/77
2013/0250122 A1 * 9/2013 Binder ..... A45D 26/00 348/162
2013/0312579 A1 * 11/2013 Childers ..... B26B 21/4056 30/45
2014/0000115 A1 * 1/2014 Sueyoshi ..... A45D 26/00 30/123
2014/0320622 A1 * 10/2014 Binder ..... A45D 26/00 348/77
2015/0059187 A1 * 3/2015 Krenik ..... B26B 19/42 30/123
2015/0126981 A1 * 5/2015 Verghese ..... A61B 5/0059 606/9
2015/0314462 A1 * 11/2015 Roman ..... H02J 7/0042 30/200
2016/0143410 A1 * 5/2016 Stampe ..... B26B 19/46 30/34.05
2016/0236360 A1 * 8/2016 Veltman ..... B26B 19/388
2019/0015999 A1 * 1/2019 Darwinkel ..... B26B 19/3813
2019/0061183 A1 * 2/2019 Neyer ..... B26B 19/38
2019/0152075 A1 * 5/2019 Hoexum ..... A45D 27/42
2019/0184586 A1 * 6/2019 Binder ..... A45D 26/00

FOREIGN PATENT DOCUMENTS

EP 1326738 A1 * 7/2003 ..... B26B 19/382
EP 1326739 A1 * 7/2003 ..... B26B 19/38
WO WO-2014206852 A1 * 12/2014 ..... B26B 19/46

* cited by examiner

SHAVER WITH LIGHT SOURCE

FIELD OF THE INVENTION

The present invention is concerned with an electronically operated hair removing device, such as a shaver, a hair or beard clipper, an epilation device or the like, having at least one electrically operated equipment, like a light source. In more detail, the present invention refers to an electrically operable shaver with a shaver housing, an energy source located in the housing, at least one hair removal unit and a light source, which is movable relative to the housing.

BACKGROUND OF THE INVENTION

Hair removing devices comprising a light source or the like electrically operated equipment which is directly connected to an energy source of the device are known. For example, an epilator is disclosed in WO 2014/206852 A1. This epilator comprises a light source which is adjustable regarding its position on the epilator and which is directly connected via a bendable cord. Further, a shaver comprising two short-hair cutter units with an internal illumination device and one long-hair trimmer unit is disclosed in EP 1 326 738 B1 and EP 1 326 739 B1. This internal illumination device is directly connected to an energy source by means of a wired connection. The use of light sources in the above-mentioned devices is either known for indicating a certain operation mode of the device, e.g. indicating that the device is turned on, indication of a specific motor or shaving mode, or for illumination of the user's skin, thereby facilitating hair removal.

A direct connection of an electrically operated equipment, like a light source, with an energy source either requires that the electrically operated equipment is arranged within the, typically sealed, housing or requires special efforts for sealing the housing and the electrically operated equipment. Especially for a movable electrically operated equipment sealing becomes more difficult. It is an object of the present disclosure to provide an improved shaver or the like hair removing device.

SUMMARY OF THE INVENTION

In accordance with one aspect of the present disclosure an electrically operable hair removing device, such as a shaver, may comprise a housing, an energy source located in the housing, at least one hair removal unit and at least one electrically operated equipment, like a light source, which is movable relative to the housing. During its use, the at least one electrically operated equipment is not directly connected to the energy source located in the housing. With respect to the present disclosure, a non-direct connection to the energy source is understood to exclude any direct wiring between the energy source and the electrically operated equipment as well as any indirect wiring, e.g. a connection between the energy source and the electrically operated equipment via a printed circuit board or the like electronic components. In other words, a non-direct connection to the energy source may include wireless power transfer and/or a power supply by means of an external energy source which is not the energy source provided in the housing, e.g. for supplying a motor. An energy source may be a battery, for example a rechargeable battery, and/or a connection to an external power supply.

A shaver according to the present disclosure may comprise an elongate shaver housing defining a longitudinal axis, at least one short-hair cutter unit, at least one long-hair trimmer unit disposed on the shaver housing and the at least one electrically operated equipment, like a light source. The longitudinal axis of the shaver housing typically runs from a distal end, i.e. the end facing towards the user's skin during use of the shaver, to an opposite proximal end, wherein the distal end is provided with the shaver head and/or the long-hair cutter unit. The at least one electrically operated equipment or appliance, e.g. the light source, may be movable substantially parallel to the longitudinal axis between a retracted position and an extended position. As an alternative to a light source the electrically operated equipment may be a heat source or heat sink or a source of radiation. The change in the position of the electrically operated equipment with respect to the user's skin may change the intensity of the equipment. For example, a light pattern and/or the illuminated area may change depending on the axial position of a light source. Further, heat transfer to the user's skin may change depending on the distance between the heat source or heat sink to the user's skin.

Further details and features of the invention may be obtained from the following description of embodiments in conjunction with the drawings.

DETAILED DESCRIPTION OF THE INVENTION

Figure 1:
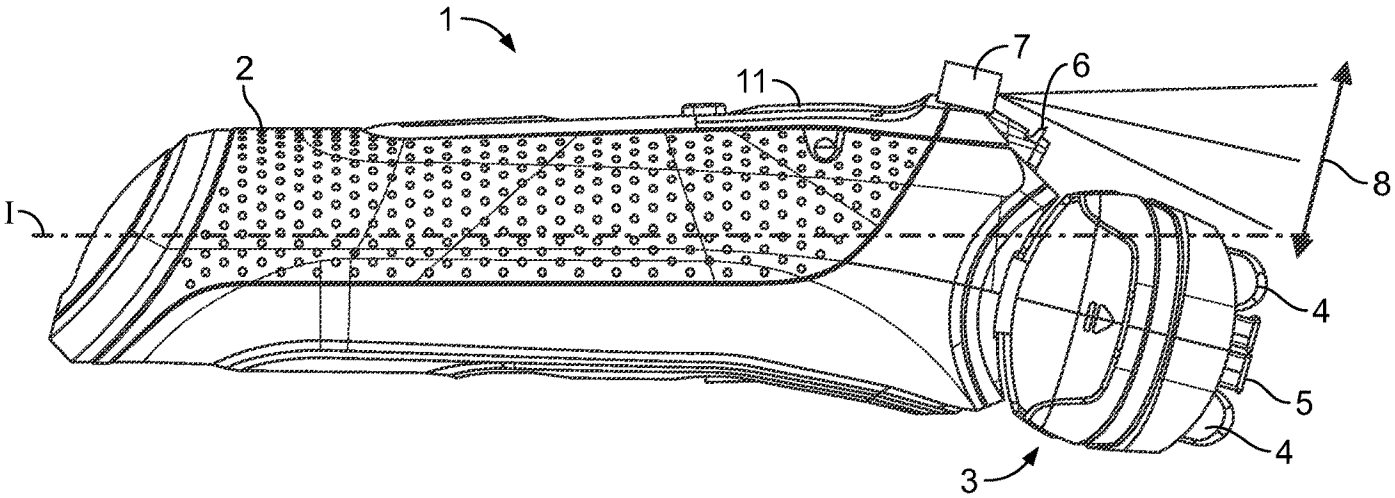
FIG. 1 shows in a schematic side view a shaver according to an embodiment of the invention with a light source in the retracted position.

The present disclosure is based on the idea that the at least one electrically operated equipment is not directly connected to the energy source located in the housing, e.g. by means of an indirect wireless connection. There are several alternatives for indirectly connecting the at least one electrically operated equipment to the energy source located in the housing. These alternatives include (but are not limited to) non-radiative near-field techniques by means of inductive coupling (electromagnetic induction), resonant inductive coupling (electrodynamic coupling), capacitive coupling (electrostatic induction) or by means of magnetodynamic coupling and radiative far-field wireless power transfer techniques, e.g. based on radio waves or microwaves. Such an indirect connection has the advantage of avoiding the limitations of movement of the at least one electrically operated equipment with respect to the housing due to a wire connection. In addition, the indirect connection may have benefits regarding sealing of the housing and at least one electrically operated equipment.

According to the first alternative, the at least one electrically operated equipment may be indirectly connected to the energy source located in the housing by means of induction coils. For example, at least one of the induction coils may be provided on a flexible printed circuit board having a thickness of less than 1.5 mm, preferably less than 0.5 mm, e.g.

about 0.2 mm. In more detail, a primary induction coil may be provided on a flexible printed circuit board sealed in the housing and a secondary induction coil may be provided on a flexible printed circuit board sealed in a component part which is movable relative to the housing, for example a long-hair trimmer unit. In other words, the secondary induction coil may be axially movable together with the movable component part relative to the primary induction coil.

The shaver or the like hair removing device typically comprises an electric motor and a, preferably rechargeable, battery as the energy source. The primary induction coil may be provided on a flexible printed circuit board or as a part of the board located adjacent to the motor, e.g. under the motor, or adjacent to the battery, e.g. under the battery. Positioning the primary induction coil under the motor may have the advantage of more space available for mounting the primary induction coil. Positioning the primary induction coil under the battery may have the benefit of less interference with the motor.

According to a further aspect of the present disclosure, the primary induction coil may have an elongate shape to ensure its function irrespective of an axial movement of the secondary induction coil and the electrically operated equipment. In addition or as an alternative, the secondary induction coil may be provided on a flexible printed circuit board or as a part of the board provided with at least one LED unit. For example, the secondary induction coil may be a round coil for best efficiency.

According to a further alternative of the present disclosure, the at least one electrically operated equipment may be connected to an additional energy source, such as a battery. The battery may be a rechargeable battery. The battery may be provided in the movable component part in a releasable manner permitting replacing an empty battery. The battery may be provided externally to the main handle housing which accommodates the motor and the electrics of the shaver. For example, the additional energy source may be a coin cell, such as a lithium coin cell. The additional energy source is provided additionally to an energy source which drives the motor of the shaver.

In a shaver comprising an elongate shaver housing defining a longitudinal axis, at least one short-hair cutter unit, at least one long-hair trimmer unit disposed on the shaver housing and the at least one electrically operated equipment, like a light source, the at least one long-hair trimmer unit may be movable substantially parallel to the longitudinal axis between a retracted idle position and an extended operating position. For example, the shaver may be operated only using the short-hair cutter unit when the long-hair trimmer unit is in its retracted idle position, whereas the shaver may be operated predominantly using the long-hair trimmer unit when the long-hair trimmer unit is in its extended operating position. This change of the position of the long-hair trimmer unit may be used for movement of the light source or the like electrically operated equipment. For example, the long-hair trimmer unit may entrain the electrically operated equipment during its axial movement. According to an example of the present disclosure, the at least one electrically operated equipment may be movable together with the at least one long-hair trimmer unit between the retracted position and the extended position. This includes embodiments in which the electrically operated equipment is mechanically coupled to the long-hair trimmer unit such that the movement of the long-hair trimmer unit causes a movement of the electrically operated equipment. Such a mechanical coupling may include a gearing or the like causing as an alternative the movement of the electrically operated equipment in a different direction and/or with a different speed with respect to the long-hair trimmer unit.

In a more detailed embodiment of the present disclosure of an electrically operable shaver, the at least one electrically operated equipment is mounted on or integrated in the at least one long-hair trimmer unit. This results in a simultaneous movement in the same direction of the electrically operated equipment and the long-hair trimmer unit. For example, the at least one electrically operated equipment may be mounted on the at least one long-hair trimmer unit on a side facing away from the shaver housing.

Irrespective of the above embodiments, an electrically operable shaver, for example the shaver as defined above, comprises an elongate shaver housing defining a longitudinal axis, at least one short-hair cutter unit, at least one long-hair trimmer unit, which is disposed on the shaver housing and which is movable substantially parallel to the longitudinal axis between a retracted idle position and an extended operating position, and at least one light source, wherein the at least one light source when in its retracted position has an illuminance in the range of 200 lx to 2.000 lx in an illuminated area of a plane defined by a distal edge of the at least one short-hair cutter unit and a distal edge of the at least one long-hair trimmer unit when in its extended operating position. The plane defined by a distal edge of the at least one short-hair cutter unit and a distal edge of the at least one long-hair trimmer unit when in its extended operating position typically corresponds to the user's skin during use of the shaver. In other words, in the retracted position, the illuminance on the skin may be in the range of 200 lx to 2000 lx in the central region of the light spot or illuminated area.

The at least one light source of the shaver may emit light in a cone shape with limited opening angle. For example, the at least one light source may comprise an optical unit, like a lens or the like, for shaping an illuminated area, preferably into an elongate, oval and/or semi-circle form.

According to a further aspect, the at least one light source may generate at least one light spot having an illuminance decreasing from the center of the light spot towards its boundaries by a factor of less than 2 per mm. In other words, the boundaries of the light spot may be shaped in a way that strong contrasts are avoided. Instead, the intensity of the illumination decreases gently with increasing distance from the middle. The decrease can e.g. be less than a factor 4, preferably less than a factor 2, per mm.

Irrespective of the above embodiments, an electrically operable shaver, for example the shaver as defined above, comprises an elongate shaver housing defining a longitudinal axis, at least one short-hair cutter unit, at least one long-hair trimmer unit, which is disposed on the shaver housing and which is movable substantially parallel to the longitudinal axis between a retracted idle position and an extended operating position, and at least one light source, wherein the shaver further comprises a control unit 59 connected to the at least one light source, with the control unit being designed and adapted such that the at least one light source provides a visual feedback to a user. In other words, the light may also be used to give optical feedback to the user during the shave. This feedback can be used to deliver any desired type of information to the user. The feedback may be done by changing any property of the light, such as the intensity, the color or the duration of any on-off time intervals. The control unit may be directly connected to the primary induction coil and/or to the battery or the like energy source. The power transfer by means of induction technology may also permit data transfer. Thus, for example different LEDs may be activated by the control unit via the induction interface.

In more detail, the control unit may comprise or may be connected to at least one sensor or detector for detecting a condition or position of a shaver component or a magnitude related to the use of the shaver, wherein the control unit is designed and adapted such that the at least one light source provides a visual feedback to a user indicating the condition or position of the shaver component or a magnitude related to the use of the shaver. Such shave related magnitudes may include e.g. the force, applied onto the skin with the shaver. Further, this may include a simple feedback whether the shaver is turned on or is turned off. Further, this may include a feedback regarding an operation mode of the shaver, indication of a specific motor or shaving mode and/or a feedback regarding the charging condition of a battery.

The at least one short-hair cutter unit of the shaver may be provided with a lower cutter linearly oscillating relative to an upper cutter. For example, a short-hair cutter unit may be designed as described in EP 1 326 739 B1, i.e. with the upper cutter comprising a bend shear foil which is provided with hair capture openings. At least one long-hair trimmer unit may be provided interposed between two short-hair cutter units as suggested in EP 1 326 739 B1. According to an aspect of the present disclosure, the at least one long-hair trimmer unit of the shaver comprises two clipping combs which are linearly oscillating relative to each other. At least one long-hair trimmer unit may be located laterally spaced from the at least one short-hair cutter unit. Especially, a long-hair trimmer unit may be movable independent from the at least one short-hair cutter unit.

Different scenarios are possible for controlling the on/off status of the light source. The light source may always be on during the shave. Alternatively, it can have a default state of "on" or "off" when the shaver is turned on and the user may switch it on or off. Further, when the shaver is turned on, the light source may go into the state it had at the end of the last shave and the user may switch it on or off.

To toggle between on and off mode of the light a separate switch is located on the long hair trimmer housing. A more comfortable on/off toggling can be achieved by an automatic switch via e.g. a vibration sensor integrated in the electronic compartment of the light. This sensor reacts on the vibrations of the shaver motor. So, the light is turned on and off synchronic to the shaver.

Optionally, the user may adapt the color of the light emitted by the light source according to his preferences. The range from warm white via cold white to blue is an example for a range of colors.

Figure 2:
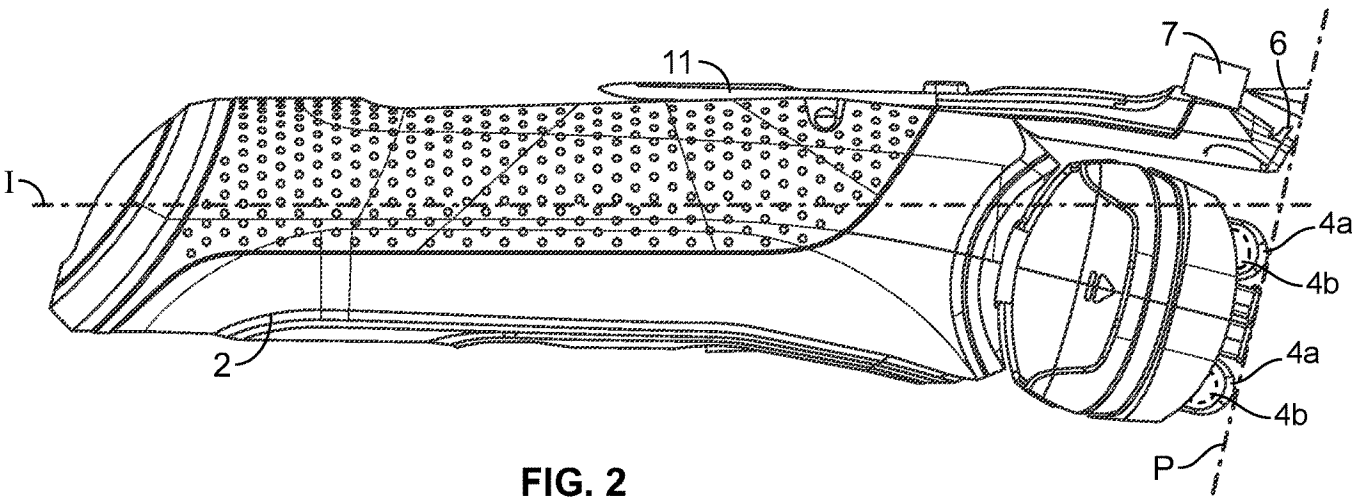
FIG. 2 shows in a schematic side view of the shaver according to FIG. 1 with the light source in the extended position, FIG. 3 schematically shows a diagram for the shaver according to FIG. 1.

In the embodiment depicted in FIGS. 1 and 2, a shaver 1 comprises a shaver housing 2 with a longitudinal axis I extending from a proximal end (left side in the Figures) to an opposite distal end facing towards the user's skin during use of the shaver 1. The longitudinal axis I indicates the orientation of the main extension of the elongate shaver housing 2 which forms a grip for holding the shaver 1 during use. FIGS. 1 and 2 depicted in the shaver housing 2 in a slightly bent outer shape, whereas the longitudinal axis I is a straight line.

The shaver 1 comprises a shaver head 3 which may be movable with respect to the shaver housing 2. For example, the shaver head 3 may swivel about at least one axis perpendicular to the longitudinal axis I. In the embodiment depicted in FIGS. 1 and 2, the shaver head 3 is provided with two short-hair cutter units 4 and a long-hair trimmer unit 5 interposed between the short-hair cutter units 4. Each short-hair cutter unit 4, comprises an upper cutter in the form of an, e.g. fixed, bent shear foil 4*a* which is provided with hair capture openings and a lower cutter 4*b* in the form of a series of blades linearly oscillating with respect to the shear foil. The long-hair trimmer unit 5 comprises two clipping blades or clipping cutters, e.g. in the form of combs, which are linearly oscillating relative to each other. The shaver head 3 is located angled with respect to the longitudinal axis I on the shaver housing 2. As an alternative, the shaver head 3 may have a different orientation, for example extending predominantly parallel to the longitudinal axis I.

An additional long-hair trimmer unit 6 is provided laterally spaced from the shaver head 3 on the upper lateral side (as seen in FIGS. 1 and 2) of the shaver housing 2. The additional long-hair trimmer unit 6 comprises two clipping blades which are linearly oscillating relative to each other. A comparison of FIGS. 1 and 2 shows that the additional long-hair trimmer unit 6 is axially movable with respect to the shaver housing 2 predominantly parallel to the longitudinal axis I. FIG. 1 shows the retracted idle position of the long-hair trimmer unit 6, whereas FIG. 2 shows the extended operation position of the long-hair trimmer unit 6.

As an alternative to the predominantly parallel movement of the long-hair trimmer unit 6 with respect to the longitudinal axis I, the long-hair trimmer unit 6 may perform a substantially parallel movement with respect to the longitudinal axis I which may include a slightly curved movement and/or a movement including an angle between the longitudinal axis I and the main direction of movement of the long-hair trimmer unit 6. The additional long-hair trimmer unit 6 may be guided on the shaver housing 2, for example by means of an axially shiftable guiding member 11 received in respective tracks (not shown) of the shaver housing 2, and may be releasably fixed in the retracted position (FIG. 1) and/or in the extended position (FIG. 2). A plane P defined by a respective distal edge of the short-hair cutter units 4 and a distal edge of the additional long-hair trimmer unit 6 in its extended operating position is shown in FIG. 2. This plane P corresponds to the user's skin during use of the shaver 1.

The axial movement of the additional long-hair trimmer unit 6 may be used for switching the long-hair trimmer unit 6 on and off. For example, the long-hair trimmer unit 6 may be decoupled from a driving motor 57 of the shaver in its retracted condition and may be coupled to such a driving motor in its extended condition. As an alternative, the long-hair trimmer unit 6 may permanently operate when the shaver 1 is switched on. Typically, the shaver head 3 is predominantly used when the additional long-hair trimmer unit 6 is in its retracted position, whereas the additional long-hair trimmer unit 6 is predominantly used when the additional long-hair trimmer unit 6 is in its extended position.

A light source 7 is provided on the additional long-hair trimmer unit 6. In the embodiment depicted in FIGS. 1 and 2, the light source 7 is integrated in the additional long-hair trimmer unit 6. As an alternative, the light source 7 may be, e.g. releasably, mounted on the additional long-hair trimmer unit 6. Thus, the light source 7 is entrained by the additional long-hair trimmer unit 6 if it moves axially as described above. As a further alternative, the light source 7 may move independent of the additional long-hair trimmer unit 6, preferably substantially parallel to the longitudinal axis I, between a retracted position and an extended position.

The light source 7 may comprise at least one LED. In addition, the light source 7 may comprise at least one optical unit, like a lens, a light duct or the like, for generating a predefined pattern of light distribution and/or for guiding light. In other words, an LED may be positioned remote from the position indicated as a light source 7 in FIGS. 1 and 2 with a light duct interposed between the LED and the light source 7. Thus, light source 7 may either be an LED or the like or may indicate an exemplary position where light is emitted from the shaver 1.

As depicted in the embodiment of FIGS. 1 and 2, the light source 7 emits light in a cone shape with limited opening angle. The light cone is shaped in a way that it extends differently sidewards and vertically (as seen in FIGS. 1 and 2). The vertical extension 8 of the light cone is for example dimensioned as follows: Typically, there is a line under which the beard dominantly grows which line may have a distance of several cm to the eye. The light cone is shaped in such a way that the area on the face illuminated by the light source 7 stays under the eye when the user shaves up to this line. As a result, the user does not dazzle his eye. This may be achieved e.g. by an optics that focuses differently for different directions. An example for a simple optics with such properties is realized by using a lens in the light source 7 that is shaped like a profile with a basically semicircle cross section.

As mentioned above, the point where the light leaves the light source 7 of the shaver 1 is mounted on an element that can be shifted with respect to the shaver body, to change the distance to the skin. In the embodiment depicted in the FIGS. 1 and 2 an already existing movable or shiftable element of the shaver is used here, namely the additional long-hair trimmer unit 6 of the shaver. However, the present invention is not limited to embodiments having the light source 7 provided on or in the additional long-hair trimmer unit 6. Rather, the light source 7 may be provided on any other suitable element moving substantially parallel to the longitudinal axis I.

Mounting the light source 7 on a shiftable element offers the possibility for another setting. While the situation depicted in FIG. 1 corresponds to a non-used long-hair trimmer unit 6, the light gets new properties when the additional long-hair trimmer unit 6 is used. When the additional long-hair trimmer unit 6 is shifted towards the skin, the light cone becomes significantly shorter and illuminates a small skin area only. This area is very near to the location where the additional long-hair trimmer unit 6 touches the skin. The small distance of the light source 7 to the skin makes the illumination focused, bright and precise. It exceeds strongly the illuminance values that were given before for the retracted position of the light source 7. This is a well adapted illumination for precise working such as cutting precise shapes. So, it is well adapted to the purpose of the additional long-hair trimmer unit 6. This is of special advantage for beard styling.

In addition, the change in the light properties on a user's skin corresponds to the change of the operation mode of the shaver 1 by axially moving the additional long-hair trimmer unit 6 from its retracted idle position to its extended operation position. Thus, positioning the light source 7 in or on the additional long-hair trimmer unit 6 results in automatically adapting the light properties or of the pattern of the area illuminated by the light source 7 to the change of the operation mode of the shaver 1.

In the embodiment depicted in FIGS. 1 and 2, the light properties or the pattern of the area illuminated by the light source 7 are mainly influenced by the distance of the light source 7 to the user's skin. However, in addition or as an alternative, the light properties or the pattern of the area illuminated by the light source 7 may be further changed in response to the movement of the additional long-hair trimmer unit 6. For example, the movement of the additional long-hair trimmer unit 6 may cause a change in the intensity and/or color of the light emission of the light source 7 and/or may cause a change in the pattern or form of the area illuminated by the light source 7, e.g. by an adjustment of one or more optical units, like a lens, a shutter, the prism or an aperture.

Figure 4:
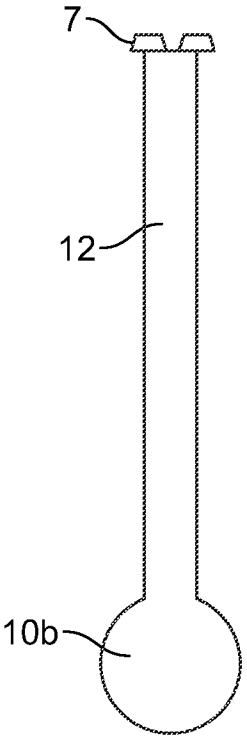
FIG. 4 shows a schematic view of a flexible printed circuit board, and FIG. 5 schematically shows an alternative diagram for the shaver according to FIG. 1.
Figure 3:
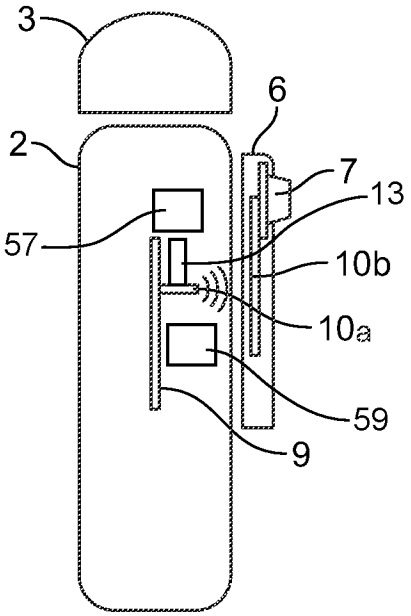

FIG. 3 schematically shows the power transfer from an energy source 9 located in the shaver housing 2 to the light source 7. This power transfer includes an induction interface with a primary induction coil 10*a* located in the shaver housing 2 and a secondary induction coil 10*b* located in the additional long-hair trimmer unit 6. The primary induction coil 10*a* and the secondary induction coil 10*b* may be provided on a flexible printed circuit board. An example for the design of such a flexible printed circuit board 12 including the secondary induction coil 10*b* and two LEDs as light sources 7 is depicted in FIG. 4. A further example for the design of such a flexible printed circuit board 13 including the primary induction coil 10*a* is depicted in FIG. 3. The primary induction coil 10*a* may have an elongate shape permitting power transfer and/or data transfer from and to the secondary induction coil 10*b* irrespective of the axial position of the secondary induction coil 10*b*, i.e. irrespective of the additional long-hair trimmer unit 6 being in its retracted position or its extended position.

Figure 5:
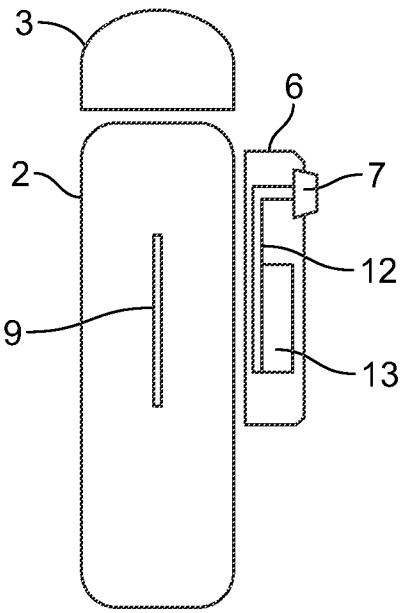

As an alternative, FIG. 5 schematically depicts an additional long-hair trimmer unit 6 having an additional energy source 13, like a coin cell. In other words, the light source 7 may be provided with an individual energy source, like a battery.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electrically operable hair removing device comprising: a housing, an energy source located in the housing, at least one hair removal unit and at least one electrically operated equipment coupled to the at least one hair removal unit, the at least one hair removal unit is movably attached to the housing, wherein, during use of the at least one electrically operated equipment, the at least one electrically operated equipment is not directly physically connected to the energy source located in the housing and the at least one electrically operated equipment is connected to the energy source located in the housing by a wireless power transfer system comprising a primary induction coil located in the housing and coupled to the energy source and a secondary induction coil located in the at least one hair removal unit and coupled to the at least one electrically operated equipment.

2. The device in accordance with claim 1, wherein at least one of the induction coils is provided on a flexible printed circuit board having a thickness of less than about 1.5 mm, the flexible printed circuit board is provided in at least one of the housing or the at least one hair removal unit.

3. The device in accordance with claim 1, wherein the primary induction coil is provided on a flexible printed circuit board in the housing and the secondary induction coil is provided on a flexible printed circuit board in the at least one hair removal unit.

4. The device in accordance with claim 1, further comprising a motor and a battery as the energy source, wherein the primary induction coil is provided on a flexible printed circuit board located adjacent to the motor or adjacent to the battery.

5. The device in accordance with claim 1, wherein the primary induction coil has an elongate shape.

6. The device in accordance with claim 1, wherein the secondary induction coil is provided on a flexible printed circuit board provided with at least one LED unit, wherein the at least one electrically operated equipment is the at least one LED.

7. The device in accordance with claim 1, wherein the housing is an elongate shaver housing defining a longitudinal axis, the at least one hair removal unit movably attached to the housing is an at least one long-hair trimmer unit, and the at least one electrically operated equipment is at least one light source which is mounted on or integrated in the at least one long-hair trimmer unit.

8. The device in accordance with claim 7, wherein the at least one long-hair trimmer unit is movably attached to the housing by an axially shiftable guiding member received on the housing substantially parallel to the longitudinal axis between a retracted idle position and an extended operating position, wherein the at least one light source is movable together with the at least one long-hair trimmer unit between the retracted position and the extended position.

9. The device in accordance with claim 8, further comprising first and second short-hair cutters both of which are connected to the housing, wherein the at least one light source when in the retracted position has an illuminance in a range of about 200 lx to about 2000 lx in an illuminated area of a plane defined by a distal edge of each of the first and second short-hair cutters and the at least one light source when in the extended operating position generates a light spot on the plane having an illuminance decreasing from a center of the light spot towards boundaries of the light spot by a factor of less than about 2 per mm.

10. The device in accordance with claim 7, further comprising a control unit in the housing and connected to the primary induction coil, wherein the control unit is configured such that the at least one light source provides visual feedback to a user.

11. The device in accordance with claim 1, further comprising at least one short-hair cutter unit connected to the housing, wherein the at least one short-hair cutter unit is provided with an inner cutter linearly oscillating relative to an outer cutter which comprises a bent shear foil which is provided with hair capture openings.

12. An electrically operable hair removing device comprising: a housing, an energy source located in the housing, at least one short-hair cutter unit connected to the housing and at least one long-hair trimmer unit, and at least one electrically operated equipment coupled to the at least one long-hair trimmer unit, the at least one long-hair trimmer unit is movably attached to the housing, wherein, during use of the at least one electrically operated equipment, the at least one electrically operated equipment is not directly physically connected to the energy source located in the housing and the at least one electrically operated equipment is connected to the energy source located in the housing by a wireless power transfer system comprising a first wireless power transfer element coupled to the energy source and a second wireless power transfer element coupled to the at least one electrically operated equipment.

13. The device in accordance with claim 12, wherein the at least one short-hair cutter unit is provided with an inner cutter linearly oscillating relative to an outer cutter which comprises a bent shear foil which is provided with hair capture openings.

* * * * *